US007260520B2

(12) United States Patent
Henn et al.

(10) Patent No.: US 7,260,520 B2
(45) Date of Patent: Aug. 21, 2007

(54) ENHANCING SOURCE CODING SYSTEMS BY ADAPTIVE TRANSPOSITION

(75) Inventors: Fredrik Henn, Bromma (SE); Kristofer Kjörling, Solna (SE); Per Ekstrand, Stockholm (SE); Lars Villemoes, Järfälla (SE)

(73) Assignee: Coding Technologies AB, Stockholm (SE)

( * ) Notice: Subject to any disclaimer, the term of this patent is extended or adjusted under 35 U.S.C. 154(b) by 901 days.

(21) Appl. No.: 10/022,526

(22) Filed: Dec. 20, 2001

(65) Prior Publication Data

US 2002/0118845 A1 Aug. 29, 2002

(51) Int. Cl.
*G10L 19/14* (2006.01)

(52) U.S. Cl. ..... 704/212; 704/228

(58) Field of Classification Search ..... None
See application file for complete search history.

(56) References Cited

U.S. PATENT DOCUMENTS

| | | | | |
|---|---|---|---|---|
| 4,398,062 | A * | 8/1983 | McRae et al. | 380/257 |
| 5,568,588 | A * | 10/1996 | Bialik et al. | 704/223 |
| 5,788,338 | A | 8/1998 | Hart et al. | |
| 5,991,717 | A * | 11/1999 | Minde et al. | 704/223 |
| 6,526,051 | B1 | 2/2003 | Kandler | |
| 6,681,202 | B1 * | 1/2004 | Miet et al. | 704/214 |
| 6,732,070 | B1 * | 5/2004 | Rotola-Pukkila et al. | 704/219 |

FOREIGN PATENT DOCUMENTS

| | | | |
|---|---|---|---|
| JP | 6-177688 | A | 6/1994 |
| KR | 0129429 | B1 | 4/1998 |
| KR | 1999-0085742 | A | 12/1999 |
| KR | 2000-0069845 | A | 11/2000 |
| WO | WO95/16260 | A1 | 6/1995 |
| WO | WO98/57436 | A2 | 12/1998 |
| WO | WO 00/45379 | A2 | 8/2000 |

OTHER PUBLICATIONS

Yasukawa, Hiroshi; Implementation of Frequency Domain Digital Filter for Speech Enhancement, Proceedings of the Third IEEE International Conference on Electronics, Circuits, and Systems, 1996, ICECS '96, Oct. 13-16, 1996, vol. 1, pp. 518-521.

* cited by examiner

*Primary Examiner*—Abul K. Azad
(74) *Attorney, Agent, or Firm*—Jeffrey Brill; Glenn Patent Group

(57) ABSTRACT

The present invention relates to a new method for enhancement of source coding systems using high-frequency reconstruction. The invention teaches that tonal signals can be classified as either pulse-train-like or non-pulse-train-like. Relying on this classification, significant improvements on the perceived audio quality can be obtained by adaptive switching of transposers. The invention shows that the so-switched transposers must have fundamental differences in their characteristics.

14 Claims, 7 Drawing Sheets

ENHANCING SOURCE CODING SYSTEMS BY ADAPTIVE TRANSPOSITION

TECHNICAL FIELD

The present invention relates to a new method for enhancement of source coding systems using high-frequency reconstruction. The invention teaches that tonal signals can be classified as either pulse-train-like or non-pulse-rain-like. Relying on this classification, significant improvements on the perceived audio quality can be obtained by adaptive switching of transposers The invention shows that the so-switched transposers must have fundamental differences in their characteristics.

BACKGROUND OF INVENTION

In "Source Coding Enhancement using Spectral-Band Replication" [WO 98/57436], transposition was defined and established as an efficient means for high frequency generation to be used in a HFR (High Frequency Reconstruction) based codec. Several transposer implementations were described. However apart from a brief discussion on transient response improvements, programme dependent adaptation of fundamental transposer characteristics was not elaborated upon.

SUMMARY OF THE INVENTION

The present invention teaches that tonal passages, i.e. excerpts dominated by contributions from pitches instruments, can be characterised as "pulse-train-like" or "non-pulse-train-like". A typical example of former is the human voice in case of vowels, or a single pitched instrument, such as trumpet, where the "excitation signal" can be modelled as a "pulse-train". The latter is the case where several different pitches are combined, and thus no single pulse-train can be identified. According to the present invention, the performance can be significantly improved, by discriminating between the above n cases, and adapting the transposer properties correspondingly.

When a pulse-train-like passage is detected, the transposer shall preferably operate on a per-pulse basis Here, the decoded lowband, serving as the input signal to the transposer, can be viewed as a series of impulse responses h(n) of lowpass character with cut off frequency $f_c$, separated by a period $T_p$. This corresponds to a Fourier series with fundamental frequency $1/T_p$, containing harmonics at all integer multiples of $1/T_p$ up to the frequency $f_c$. The objective of the transposer is to increase the bandwidth the individual responses h(n) up to the desired bandwidth $Nf_c$ where N is the transposition factor, without altering the period $T_p$. Since the pulse period is preserved, the transposed signal still corresponds to a Fourier series with fundamental $1/T_p$, now containing all partials up to $Nf_c$. Hence this method provides a perfect continuation to the truncated Fourier series of the lowband. Some prior art methods satisfy the requirement of preservation of the pulse period. Examples are frequency translation, and FD-transposition according to [WO 98/57436], where the window is selected short enough not to contain more than one period, i.e. length(window)$\leqq T_p$. Neither of those implementations handle material with multiple pitches well, and only the FD-transposition provides a perfect continuation to the truncated Fourier series of the lowband.

When a non-pulse-train-like passage is detected e.g. when multiple pitches are at hand, the demands on the transposer instead shifts from preservation of pulse periods to preservation of integer relationships between lowband harmonics and generated higher partials. This requirement is met by the FD-transposition methods in [WO 98/57436], where the window is selected long enough that many periods $T_i$ of the individual pitches forming the sequence are contained within one window, i.e. length(window)>>$T_i$. Hereby any truncated Fourier series [$f_i$, $2f_i$, $3f_i$, . . . ] in the transposer source frequency range is transposed to [$Nf_i$, $2Nf_i$, $3Nf_i$, . . . ], where N is the integer transposition factor. Clearly, as opposed to the above per-pulse operation, his scheme does not generate a full continuation of the lowband Fourier series. This is tolerable for multi pitched signals, but not ideal for the single pitch pulse-train-like case. Thus, this transposition mode is preferably only used in non-pulse-train-like cases.

According to the present invention, discrimination between pulse-like and non-pulse-like signals can be performed in the encoder, and a corresponding control signal sent to the decoder. Alternatively, the detection can be done in the decoder, eliminating the need for control signals but at an expense of higher decoder complexity. Examples of detector principles are transient detection in the time domain, as well as peak-picking in the frequency domain. The decoder includes means for the necessary transposer adaptation. As an example, a system using frequency translation for the pulse-train-like case, and a long window FD transposer for the non-pulse train-like case, is described. The actual switching or cross fading between transposers is preferably performed in an envelope-adjusting filterbank.

The present invention comprises the following features:

- Adaptively over time selecting different methods for high frequency generation, based on whether the signal being processed has a pulse-train-like character or a non-pulse-train-like character
- the selection is done based on analysis by peak-picking in a time- and frequency-domain representation of the signal.
- the different methods for high frequency generation are frequency translation and FD transposition, or
- the different methods for high frequency generation are FD transposition with different window size or
- the different methods for high frequency generation are time-domain pulse train transposition and FD transposition.

BRIEF DESCRIPTION OF THE DRAWINGS

The present invention will now be described by way of illustrative examples, not limiting the scope or spirit of the invention, with reference to the accompanying drawings, in which.

DESCRIPTION OF PREFERRED EMBODIMENTS

The below-described embodiments are merely illustrative for the principles of the present invention for adaptive transposer switching for HFR systems. It is understood that modifications and variations of the arrangements and the details described herein will be apparent to others skilled in the art. It is the intent therefore, to be limited only by the scope of the impending patent claims and not by the specific details presented by way of description and explanation of the embodiments herein.

"Ideal transposition" of a single pitched pulse-train-like signal can be defined by means of a simple model. Let the original signal be a sum of diracs δ(n), separated by m samples, i.e. a pulse-train $$x(n) = \sum_{l=-\infty}^{\infty} \delta(n - lm) \quad \text{(Eq. 1)}$$

Figure 1A:
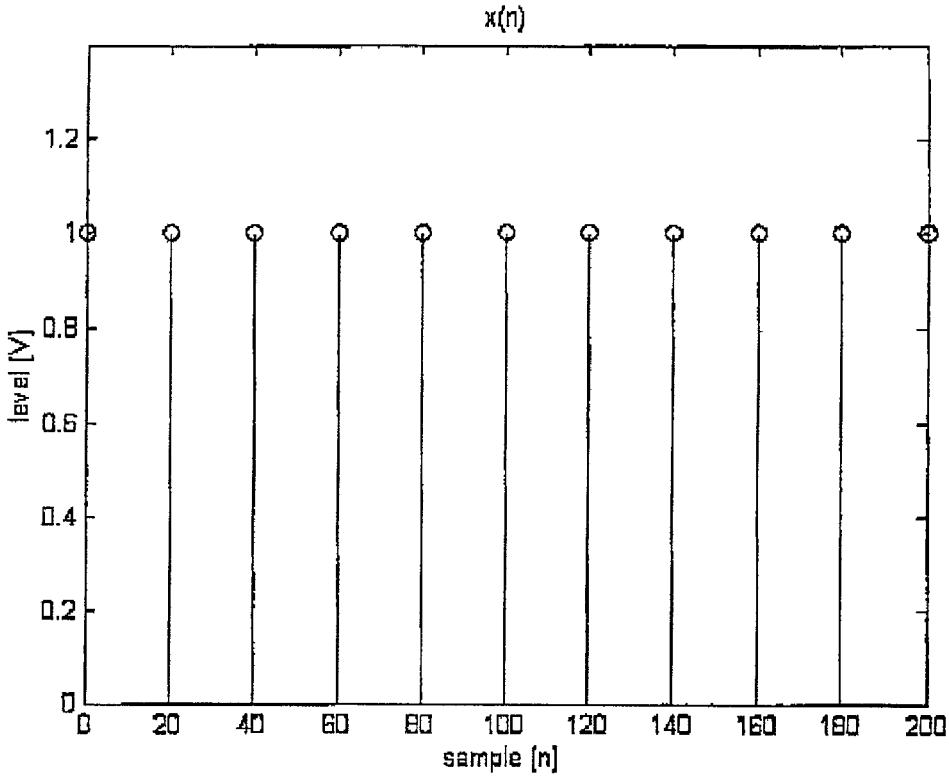
FIG. 1*a* illustrates an input pulse-train signal x(n).
Figure 1B:
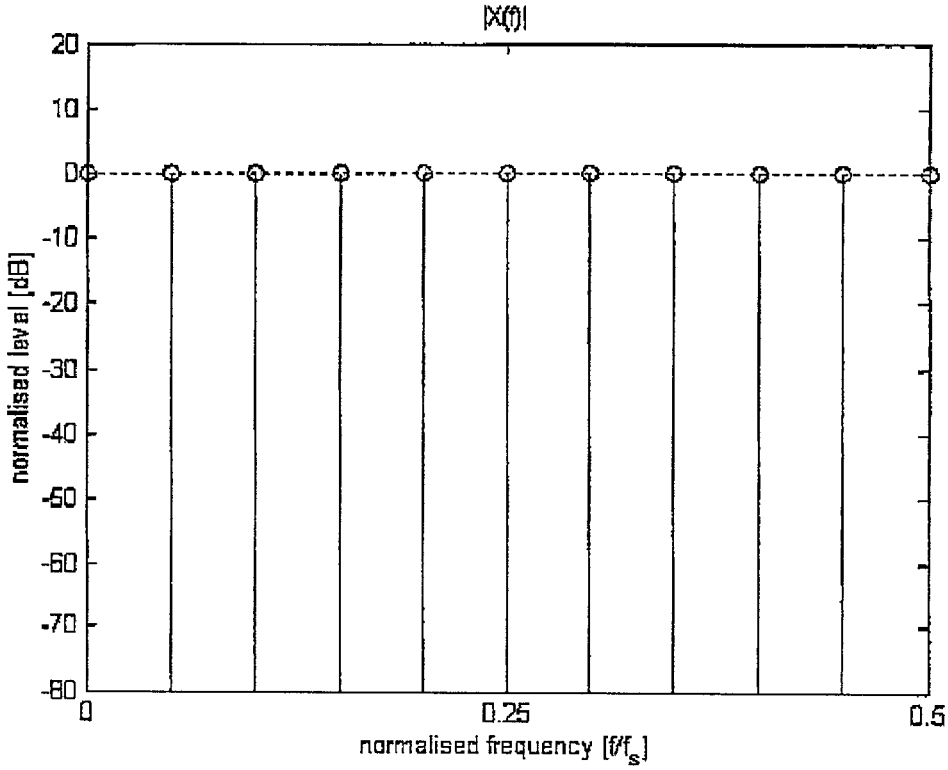
FIG. 1*b* illustrates the magnitude spectrum |X(f)| of the signal x(n).
Figure 2A:
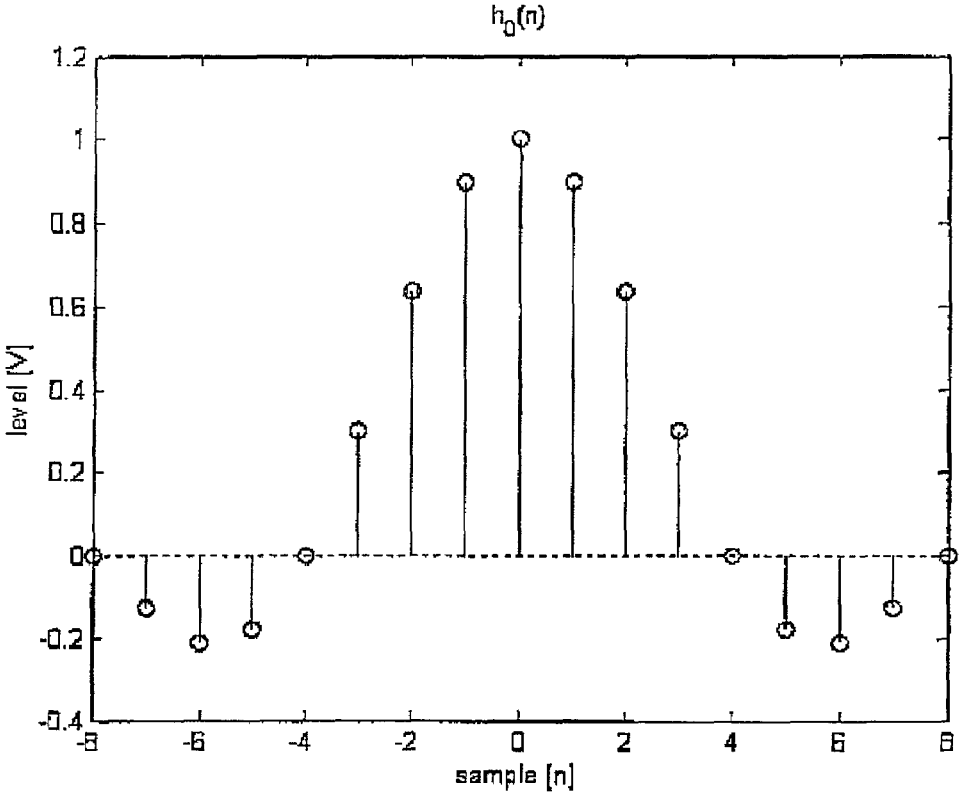
FIG. 2*a* illustrates the impulse response $h_0(n)$ of a FIR filter.
Figure 2B:
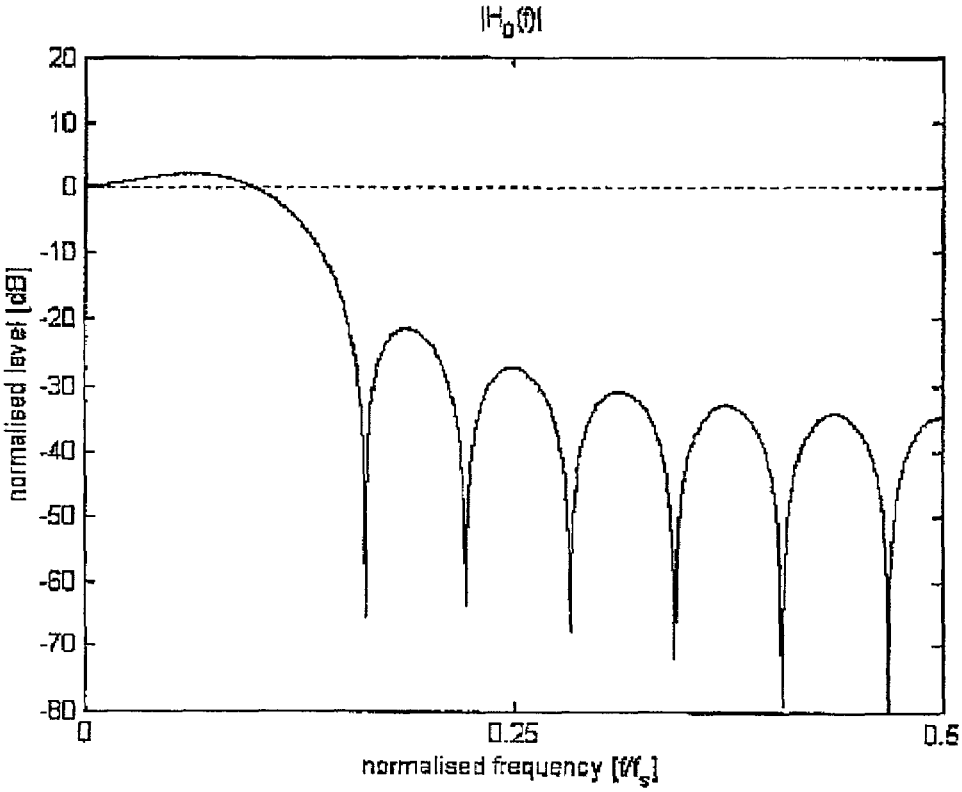
FIG. 2*b* illustrates file magnitude spectrum $|H_0(f)|$ of the FIR filter.
Figure 3A:
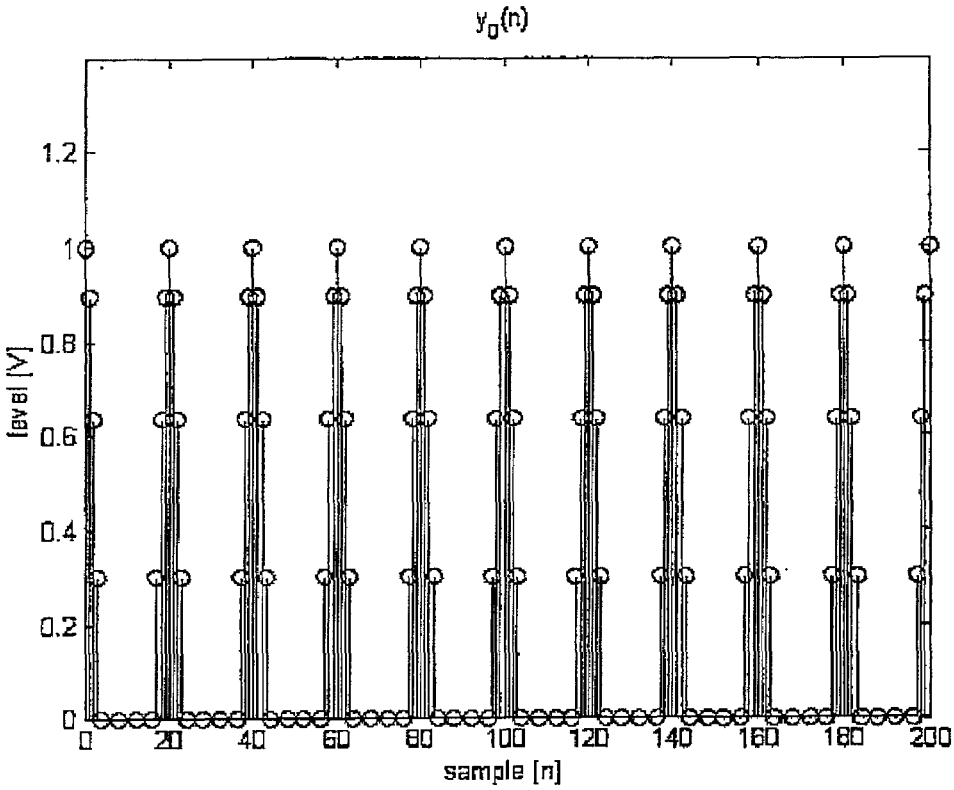
FIG. 3*a* illustrates a signal $Y_0(n)=x(n)*h_0(n)$.
Figure 3B:
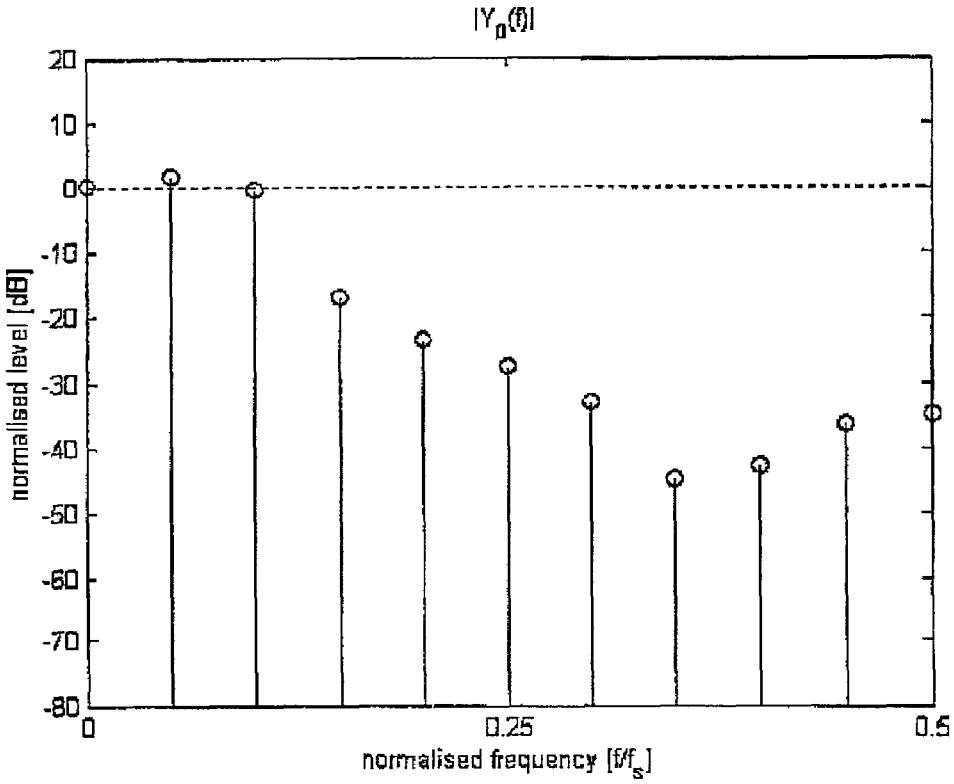
FIG. 3*b* illustrates the magnitude spectrum $|Y_0(f)|$ of the signal $y_0(n)$.
Figure 4A:
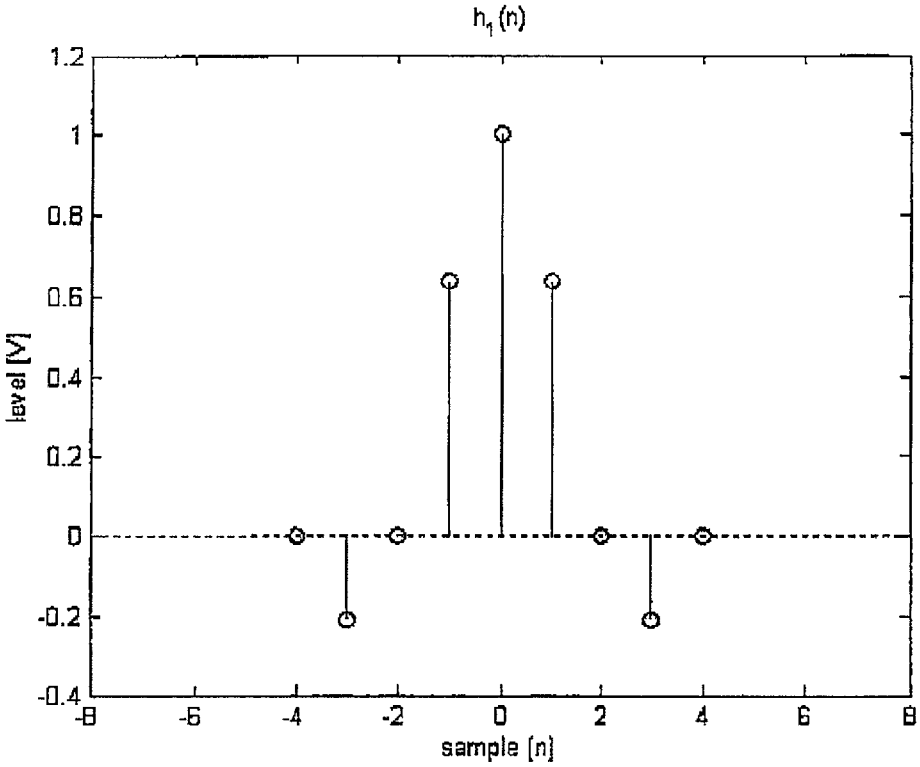
FIG. 4*a* illustrates the decimated impulse response $h_1(n)$ of a FIR filter
Figure 4B:
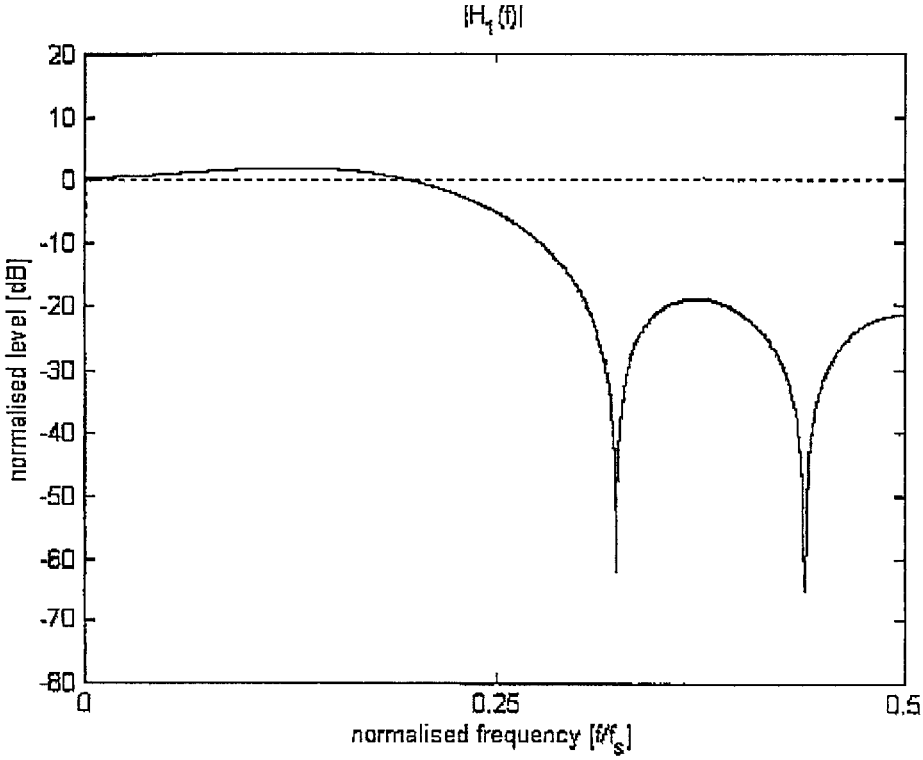
FIG. 4*b* illustrates the magnitude spectrum $|H_1(f)|$ of the decimated FIR filter.
Figure 5A:
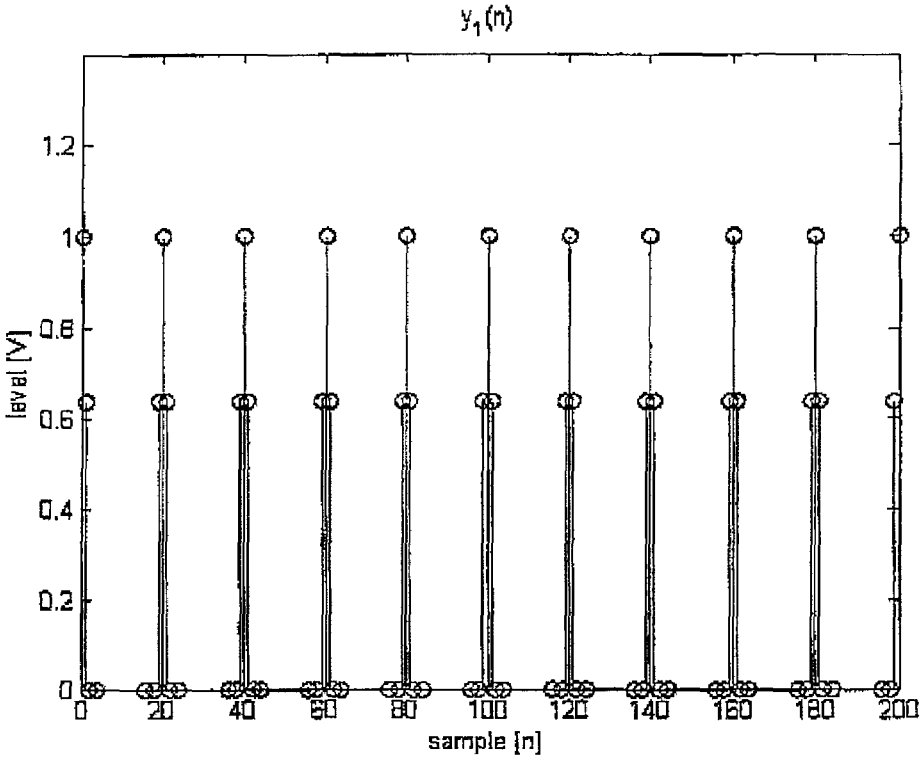
FIG. 5*a* illustrates the transposed signal $y_1(n)$.
Figure 5B:
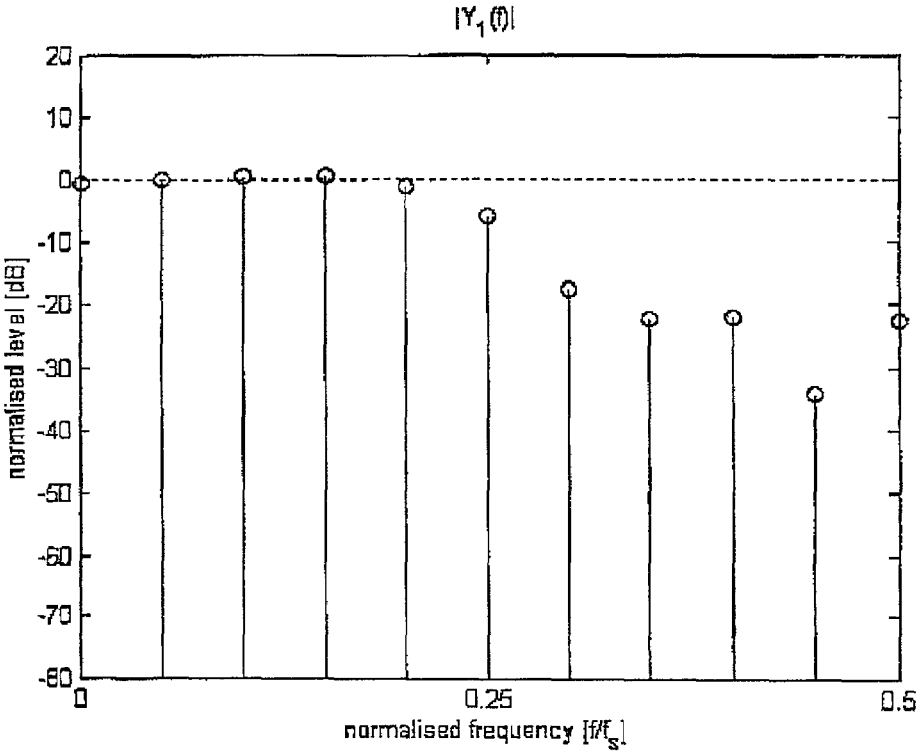
FIG. 5*b* illustrates the magnitude spectrum $|Y_1(f)|$ of the signal $y_1(n)$.

FIG. 1*a* shows x(n), and FIG. 1*b* the corresponding magnitude spectrum |X(f)|. Clearly |X(f)| corresponds to a of a Fourier series with fundamental $f_s/m$, where $f_s$ is the sampling frequency. Let y(n) be a low-pass filtered version of x(n), where the low-pass FIR filter has the impulse response $h_0(n)$ of length p such that p<m, see FIGS. 2*a* and 2*b* for the time and frequency domain representation respectively. The filter cut-off frequency is $f_c$. The output signal is then given by $$y_0(n) = x(n) * h_0(n) = \sum_{l=-\infty}^{\infty} \delta(n - lm) * h_0(n) = \sum_{l=-\infty}^{\infty} h_0(n - lm) \quad \text{(Eq. 2)}$$

i.e. a series of impulse responses, separated by m samples. FIGS. 3*a* and 3*b* show $y_0(n)$ and $|Y_0(f)|$. The original Fourier series has effectively been truncated at the frequency $f_c$. Assume that a time domain based transposer is able to detect the individual impulse responses $h_0(n-1m)$, and that those signals are decimated by a factor 2, i.e. every second sample is fed to the output. The discarded samples are compensated for by insertion of zeroes between the shorter responses $h_1(n-1m)$, in order to preserve the length of the signal. The decimated impulse response $h_1(n)$ and the corresponding frequency representation $|H_1(f)|$ are shown in FIGS. 4*a* and 4*b*. Obviously, the narrowing of the time domain signal corresponds to a widening of the frequency domain signal, in this case by a factor 2. Finally, the transposed signal $$y_1(n) = \sum_{l=-\infty}^{\infty} h_1(n - lm)$$

and $|Y_1(f)|$ is shown if FIGS. 5*a* and 5*b*. The bandwidth of the LP filtered pulse-train has been increased, while pressing the correct time and thereby also frequency, properties. The output signal $y_1(n)$ corresponds to a Fourier series with partials reaching up to the frequency $2f_c$.

The above transposition can be approximated in several ways. One approach is to use a frequency domain transposer (FD-transposer) such as the STFT transposer described in [WO 98/57436], but with different window sizes, i.e. a short window is used for pulse-train signals, and a long window is used for all other signals. The short window (of length≦m in the above example) ensures that the transposer operates on per pulse basis, giving the desired pulse transposition outlined above. A different approach for pulse transposition is using single-side-band modulation. This ensures that the period time between the pulses $T_p$ is correct, however, the generated partials are not harmonically related to the partials of the lowband. It should also be pointed out that different pulse-train transposition algorithms may perform differently for different program material. Therefore several pulse-train transposers could be used with suitable detection algorithms, in the encoder and/or the decoder, to ensure optimal performance.

Figure 6:
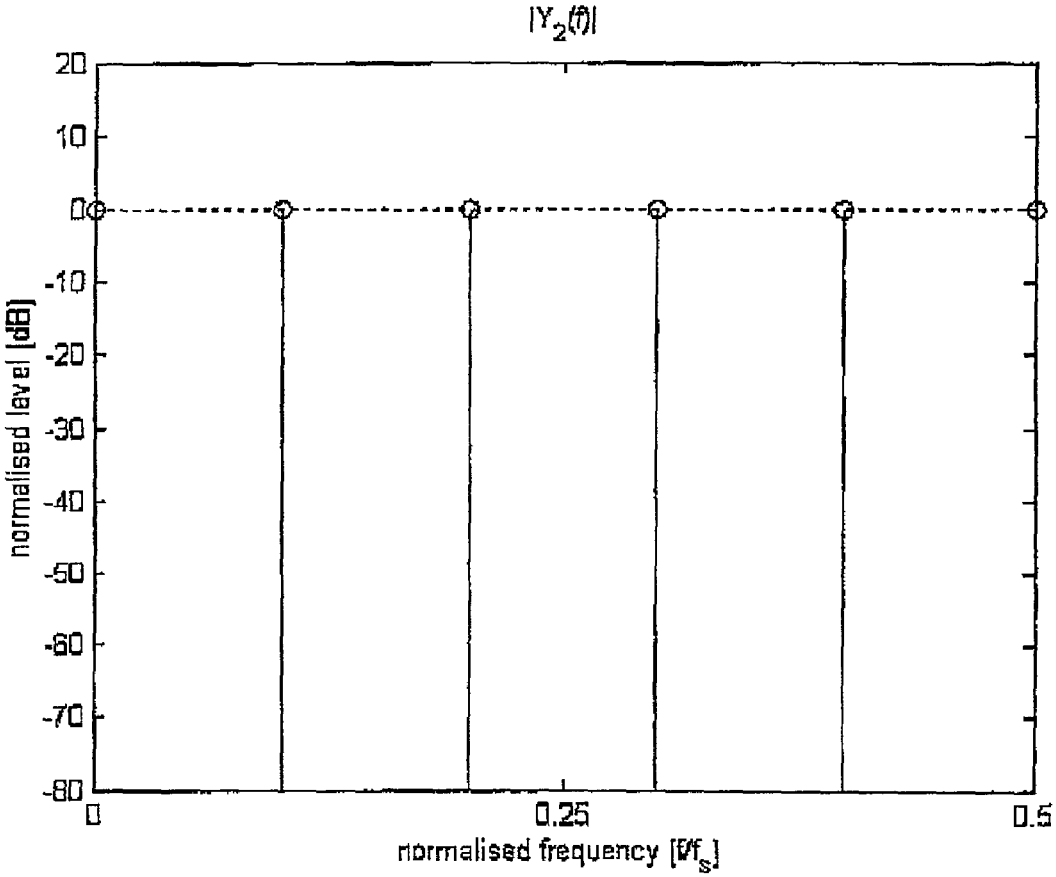
FIG. 6 illustrates the magnitude spectrum $|Y_2(f)|$, after FD-transposition with a long window of the signal x(n).

For the pulse-train signal used in the example above, an implementation with a FD-transposition method using a long window will give unsatisfactory results. This is due to the following:

When using a long window (of length>>m) in the FD-transposition method, the following relation applies:

$$u(n) = \sum_{i=0}^{N-1} e_i(n)\cos(2\pi f_i n / f_s + \alpha_i) \rightarrow v(n) = \sum_{i=0}^{N-1} e_i(n)\cos(2\pi M f_i n / f_s + \beta_i), \quad \text{(Eq. 3)}$$

where u(n) is the input, y(n) is the output, M is the transposition factor, N is the number of sinusoids, $e_i(n)$, $\alpha_i$ are the individual input frequencies, time envelopes and phase constants respectively, $\beta_i$ are the arbitrary output phase constants and $f_s$ is the sampling frequency, and $0 \leqq Mf_i \leqq f_s/2$. The input signal x(n) will using the relation in Eq. 3 yield an output signal $y_2(n)$ with a magnitude spectrum $|Y_2(f)|$ according to FIG. 6, where the partials of $y_2(n)$ are harmonically related to the partials of x(n). However the distance between them has increased according to the transposition factor, i.e. the pitch of the signal has increased by the transposition factor. When adding this new highband signal to the original lowband signal, the two different pitches can clearly be discriminated. This causes for instance speech signals to sound as if an additional speaker was speaking simultaneously but at a higher pitch, i.e. a so called ghost voice occurs.

However, as soon as the input signal does not display single-pitched pulse-train characteristics, a pulse transposition is not applicable if high-quality HFR is required. Thus it is highly desirable to detect which transposition method that gives the best result at a given time, in order to optimise performance of the HFR system.

In order to benefit from the different transposition characteristics in a decoder it is necessary to, in the encoder and/or the decoder, asses which transposition method will give the best results at a given time. There are several ways to detect pulse-train-like characteristics in a signal, it can be done in either the time-domain or in the frequency domain. If a pulse train has a period time $T_p$ the pulses will be separate in time by that period time and the frequency components will be $1/T_p$ apart. Hence if $T_p$ is high, i.e. a low-pitched pulse-train, this is preferably detected in the time domain since the pulses are relatively far apart and thus easy to discriminate. However, if $T_p$ is low, this corresponds to a high-pitched pulse-train and hence it is more easily detected in the frequency domain. For time domain detection it is preferable to spectrally whiten the signal in order to obtain an as pulse train like character as possible for easier detection. The detection schemes in the time domain and the frequency domain are solar. They are based on peak picking and statistical analysis of the distances between picked peaks. In the time domain the peak-picking is done by comparing the energy and peak level of the signal before and after an arbitrary point, thus searching for transient behaviour in the signal. In the frequency domain the peak detection is done on the harmonic product spectrum, which is a good indication if a strong harmonic series is present. The distances between the detected pitches are presented in a histogram upon which the detection is made by comparing the ratio between pitch-related entries and non-pitch related entries.

Figure 7:
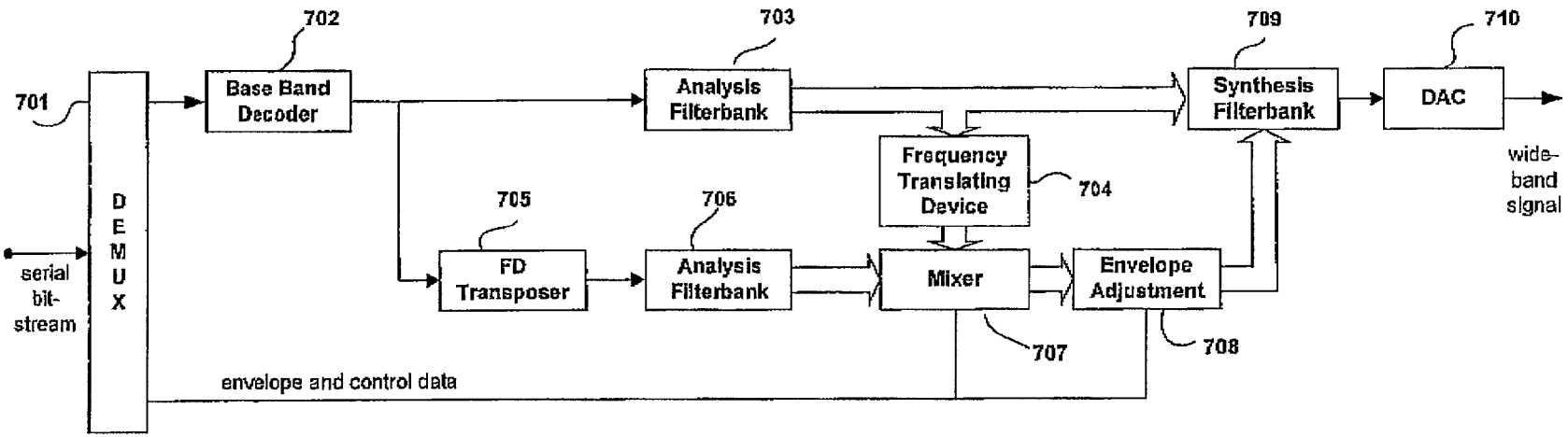
FIG. 7 illustrates an implementation of the present invention on the decoder side.

The implementation exemplified in FIG. 7 shows the usage of two different types of transposition methods in the same decoder system—the types being a FD transposer using a long window and a frequency translating device [PCT/SE01/01150]. The demultiplexer 701 unpacks the bitstream signal and feeds it to an arbitrary baseband decoder 702. The output from the baseband decoder, i.e. a bandwidth-limited audio signal, is fed to an analysis filterbank 703, which splits the audio signal into spectral bands. The audio signal is simultaneously fed to an FD-transposer unit 705. The output therefrom is fed to an additional analysis filterbank 706, which is of the same type as the filterbank unit 703. The data from the filterbank unit 703 is patched 704 according to the principles of frequency translating devices and fed to the mixing unit 707 together with the output from the analysis filterbank 706. The mixing unit blends the data according to the control signal transmitted from the encoder or control signals obtained by the decoder. The blended spectral data is subsequently envelope adjusted in the envelope adjuster 708, using data and control signals sent in the bitstream. The spectral-adjusted signal and the data from the analysis filterbank 703 are fed to a synthesis filterbank unit 709, thus creating an envelope adjusted wideband signal. Finally, the digital wideband signal is converted 710 to an analogue output signal.

The invention claimed is:

1. Apparatus for producing a high-frequency reconstruction signal based on a bandwidth-limited audio signal, comprising:

means for obtaining information, whether a to be processed passage of the bandwidth-limited audio signal has a pulse-train-like character or a non-pulse-train-like character, wherein a passage has a pulse-train-like character, when the passage includes a series of pulses having associated therewith a pulse period, and wherein a passage has a non-pulse-train-like character, when the passage does not include a series of pulses having associated therewith the pulse period;

means for adaptively over time selecting different methods for high-frequency generation for passages to be processed based on the information; and means for performing a selected high-frequency generation method for a passage of the bandwidth-limited audio signal to obtain the high-frequency reconstruction signal.

2. Apparatus in accordance with claim 1, in which the means for obtaining is arranged for receiving a control signal indicating whether a passage has a pulse-train-like character or a non-pulse-train-like character.

3. Apparatus in accordance with claim 1, in which the means for obtaining includes a detector for detecting, whether a passage has a pulse-train-like character or a non-pulse-train-like character, wherein the detector is arranged for performing a transient detection in a time domain or a peak-picking operation in the frequency domain.

4. Apparatus in accordance with claim 3, in which the detector is arranged for performing the transient detection, when the pulse period is comparatively high, and in which the detector is arranged for performing the peak-picking operation, when the pulse period is comparatively low.

5. Apparatus in accordance with claim 3 or claim 4, in which the detector is arranged for performing a spectrally whiten step for spectrally whiten a passage before performing the detection.

6. Apparatus in accordance with claim 3 or claim 4, in which the detector is arranged to conduct a step of performing a peak-picking operation and a step of performing a statistical analysis of distances between picked peaks.

7. Apparatus in accordance with claim 6, in which the detector is arranged to conduct a step of comparing an energy and a peak level of a signal before and after an arbitrary point so that a transient behavior in the signal is searched for.

8. Apparatus in accordance with claim 6, in which the detector is arranged for conducting a step of peak-detecting on a harmonic product spectrum so that detected pitches are presented in a histogram, upon which a detection is made by comparing a ratio between pitch-related entries and non-pitch-related entries in the histogram.

9. Apparatus in accordance with claim 8, in which the means for performing a selected method includes:

a frequency-domain transposer, a first analysis filterbank connected to the frequency-domain transposer, a second analysis filterbank;

a frequency translating device being connected to an output of the second analysis filterbank, wherein the second analysis filterbank is a filterbank of the same type as the first analysis filterbank, a mixer for blending an output from the first filterbank and an output of the frequency translating device, the mixer being arranged for blending in accordance with a control signal to output blended spectral data, and an envelope adjuster for performing an envelope adjustment on the blended spectral data using envelope data to provide the high-frequency reconstruction signal.

10. Apparatus in accordance with any one of claims 1-4, in which the different methods for high-frequency generation include frequency-domain transpositions with different window sizes, wherein a comparatively small window size is selected for a passage having a pulse-train-like character, and wherein a comparatively long window size is selected for a passage having a non-pulse-train-like character.

11. Apparatus in accordance with claim 10, in which the small window size is shorter than or equal to the pulse period.

12. Apparatus in accordance with any one of claims 1-4, in which the different methods for high-frequency generation include a frequency translation for a passage having a pulse-train-like character and a frequency-domain transposition for a passage having a non-pulse-train-like character, wherein a window size of the frequency-domain translation is larger than $1/f_l$, wherein $f_l$ is a frequency of a truncated Fourier series.

13. Apparatus in accordance with any one of claims 1-4, in which the different methods for high-frequency generation include a time-domain pulse-train transposition for a passage having a pulse-train-like character and a frequency-domain transposition having a non-pulse-train-like character, wherein the window size of the frequency-domain position is larger than $1/f_l$, wherein $f_l$, is a frequency of a truncated Fourier series.

14. Method for producing a high-frequency reconstruction signal based on a bandwidth-limited audio signal, comprising the following steps:

obtaining information, whether a to be processed passage of the bandwidth-limited audio signal has a pulse-train-like character or a non-pulse-train-like character, wherein a passage has a pulse-train-like character, when the passage includes a series of pulses having associated therewith a pulse period, and wherein a passage has a non-pulse-train-like character, when the passage does not include a series of pulses having associated therewith the pulse period;

adaptively over time selecting different methods for high-frequency generation for passages to be processed based on the information; and performing a selected high-frequency generation method for a passage of the bandwidth-limited audio signal to obtain the high-frequency reconstruction signal.

* * * * *

UNITED STATES PATENT AND TRADEMARK OFFICE

CERTIFICATE OF CORRECTION

PATENT NO. : 7,260,520 B2
APPLICATION NO. : 10/022526
DATED : August 21, 2007
INVENTOR(S) : Fredrik Henn et al.

It is certified that error appears in the above-identified patent and that said Letters Patent is hereby corrected as shown below:

Title Page should read

[30] Foreign Application Priority Data: Dec. 22, 2000 (SE) 0004818-1

Signed and Sealed this

Eleventh Day of December, 2007

JON W. DUDAS
*Director of the United States Patent and Trademark Office*